US009347298B2

(12) United States Patent
Watson

(10) Patent No.: US 9,347,298 B2
(45) Date of Patent: May 24, 2016

(54) HIGH PRESSURE TIE BACK RECEPTACLE AND SEAL ASSEMBLY

(71) Applicant: HALLIBURTON ENERGY SERVICES, INC., Houston, TX (US)

(72) Inventor: Brock Watson, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 222 days.

(21) Appl. No.: 13/776,359

(22) Filed: Feb. 25, 2013

(65) Prior Publication Data

US 2014/0238692 A1 Aug. 28, 2014

Related U.S. Application Data

(63) Continuation of application No. 13/818,787, filed as application No. PCT/US2012/047594 on Jul. 20, 2012.

(60) Provisional application No. 61/510,395, filed on Jul. 21, 2011.

(51) Int. Cl.
*E21B 43/10* (2006.01)

(52) U.S. Cl.
CPC ..... *E21B 43/106* (2013.01)

(58) Field of Classification Search
USPC ..... 166/242.6, 380
See application file for complete search history.

(56) References Cited

U.S. PATENT DOCUMENTS

| | | | | |
|---|---|---|---|---|
| 4,491,351 | A * | 1/1985 | Galle et al. | 285/318 |
| 6,905,149 | B2 * | 6/2005 | DeLange et al. | 285/334 |
| 7,895,726 | B2 * | 3/2011 | Maguire | 29/505 |
| 2004/0216889 | A1 * | 11/2004 | Fraser, III | 166/380 |

* cited by examiner

*Primary Examiner* — David Andrews
(74) *Attorney, Agent, or Firm* — Haynes and Boone, LLP

(57) ABSTRACT

A tie back assembly and method of use is presented. In one method, a tie back seal mandrel is inserted into a tie back receptacle. Both the inner surface of the tie back receptacle and the outer surface of the seal mandrel are tapered to cooperate when mated. A seal assembly forms an annular seal between the tapered surfaces when the mandrel is inserted into the receptacle. Preferably the seal assembly has a burst seal and a collapse seal carried on one of the tapered surfaces, where the seals are spaced apart longitudinally. The seals are positioned at locations along the tapered surfaces to provide adequate wall thickness for support at pressure. Hydrostatic fluid in the wellbore increases the force necessary to withdraw the seal mandrel dues to creation of a lower pressure zone between the spaced apart seals.

17 Claims, 3 Drawing Sheets

HIGH PRESSURE TIE BACK RECEPTACLE AND SEAL ASSEMBLY

CROSS REFERENCE TO RELATED APPLICATIONS

This application is a continuation of U.S. patent application Ser. No. 13/818,787, filed on May 30, 2013, which is a United States National Stage Entry of International Application No. PCT/US2012/047594, filed on Jul. 20, 2012. Each patent application identified above is herein incorporated in its entirety for all purposes. International Application No. PCT/US2012/047594, filed on Jul. 20, 2012, claims priority to U.S. Provisional Application No. 61/510,395, filed on Jul. 21, 2011.

BACKGROUND

1. Technical Field

The present invention relates to equipment and methods used in subterranean wells, and more particularly to a tie back seal and tie back seal receptacle assembly and method.

2. Background Art

Wellbores are typically formed by drilling and thereafter lining a borehole with steel pipe called casing. The casing provides support to the wellbore and facilitates the isolation of certain areas of the wellbore adjacent hydrocarbon bearing formations. The casing typically extends down the wellbore from the surface of the well and the annular area between the outside of the casing and the borehole in the earth is filled with cement to permanently set the casing in the wellbore.

As the wellbore is drilled to a new depth, additional strings of pipe are run into the well to that depth whereby the upper portion of the string of pipe, or liner, is overlapping the lower portion of the casing. The liner string is then fixed or hung in the wellbore, usually by some mechanical means such as a setting sleeve hanger, expandable hanger, or other means well known in the art.

In some instances wells are completed with the remote perforating of liner to provide a fluid path for hydrocarbons to enter the wellbore where they flow into a screened portion of another smaller tubular or production tubing. In these instances, the wellbore around the tubing is isolated with packers to close the annular area and urge the hydrocarbons into the production tubing. In other completions, the last string of liner extending into the wellbore is itself pre-slotted or perforated to receive and carry hydrocarbons upwards in the wellbore. In these instances, production tubing is usually connected to the top of the liner to serve as a conduit to the surface of the well. In this manner, the liner is "tied back" to the surface of the well.

In order to complete these types of wells, the production tubing is inserted in the top of a liner in a sealing relationship usually accomplished by utilization of a polished bore receptacle in the liner top. A polish bore receptacle has a smooth cylindrical inner bore designed to receive and seal a tubular having a seal assembly on its lower end. The polished bore receptacle and seal assembly combination allows the production tubing to be "stung" into the liner in a sealing relationship and be selectively removed therefrom. As herein, the term "polished bore receptacle" refers to a device used to locate and seal a first tubular in a second tubular. The term "smooth bore receptacle" is also used in the industry. For disclosure regarding tie back receptacles and tie back seal mandrels consider the following U.S. Patents and U.S. Patent Application Publications, each of which are incorporated herein by reference for all purposes: 2009/0200041, A1, to Watson, filed Feb. 7, 2008; 2006/0269360, to Rowley, published November, 2006; 2005/0217866, to Watson, published October 2005; 2006/0065403, to Watson, published March 2006;, U.S. Pat. No. 7,195,073, to Fraser, filed May 1, 2003;, U.S. Pat. No. 7,854,266, to Watson; U.S. Pat. No. 7,779,910, issued Aug. 24, 2010, to Watson; U.S. Pat. No. 6,056,061, to Ross. For further disclosure, see SPE 106757, *Expandable Liner Hanger Resolves Sealing Problems and Improves Integrity in Liner Completion Scenarios*, James Willford and Pete Smith (2007), which is incorporated herein by reference for all purposes.

Mechanical mechanisms, such as latches, are also used in the industry to hold tie back seal mandrels in position in relation to tie back receptacles. For example, commercial latches are available from Halliburton Energy Services, Inc., under the trade names Ratch Latch and Versalatch.

One common type of tie back assembly is a mono-diameter tie back assembly. The typical mono-diameter tie back receptacle (TBR) and seal mandrel for a liner generally have a pressure rating about half the liner pressure rating because geometric limitations require the TBR and the seal mandrel to each be approximately half the liner thickness. The assembly has a relatively low pressure rating, which limits the use of the tie back assembly and makes it unworkable in some wells.

Consequently, there exists a need for a tie back assembly with an increased pressure rating for the tie back seal and the TBR. Improvement of the pressure rating should allow use of such tie back assemblies in, for example, deep water wells. Deep water wells require higher pressure ratings for liners. Further, new government and industry regulations may require higher pressure ratings. The disclosed invention has higher pressure ratings than prior art assemblies.

SUMMARY OF THE INVENTIONS

Embodiments of the present invention generally relate to methods and apparatus for completing a well. Exemplary methods and apparatus for assembling a tie back receptacle member and a tie back seal member in a wellbore extending through a subterranean formation is provided. In one method, the tie back receptacle member having a tie back receptacle is positioned and hung on a casing along the wellbore. A tie back seal member having a seal mandrel is run into the wellbore and positioned so the seal mandrel fits into the tie back receptacle. Both the inner surface of the tie back receptacle and the outer surface of the seal mandrel are tapered to cooperate when mated. A seal assembly forms an annular seal between the tapered surfaces when the mandrel is inserted into the receptacle. The tie back receptacle member can further include a hanger body, an expandable hanger body, hanger seals, and setting sleeve. Preferably the seal assembly has a burst seal and a collapse seal carried on one of the tapered surfaces, where the seals are spaced apart longitudinally. The seals are positioned at locations along the tapered surfaces to provide adequate wall thickness for support at pressure. Hydrostatic fluid in the wellbore preferably assists in maintaining the seal mandrel and receptacle in position. Wellbore fluid flows from an annular space defined between the spaced apart seals, thereby creating a lower pressure zone. Upon disconnect, the lower pressure zone acts to enlarge the seal mandrel and shrink the tie back receptacle, thereby increasing the friction between the mandrel and receptacle. Additional features can be added, such as cooperating grooves and ridges on the mating tapered surfaces, latches, etc. A tie back assembly and methods of use are disclosed herein.

BRIEF DESCRIPTION OF THE DRAWINGS

The drawing is incorporated into and forms a part of the specification to illustrate at least one embodiment and example of the present invention. Together with the written description, the drawing serves to explain the principles of the invention. The drawing is only for the purpose of illustrating at least one preferred example of at least one embodiment of the invention and is not to be construed as limiting the invention to only the illustrated and described example or examples. The various advantages and features of the various embodiments of the present invention will be apparent from a consideration of the drawing in which.

DETAILED DESCRIPTION

Figure 1:
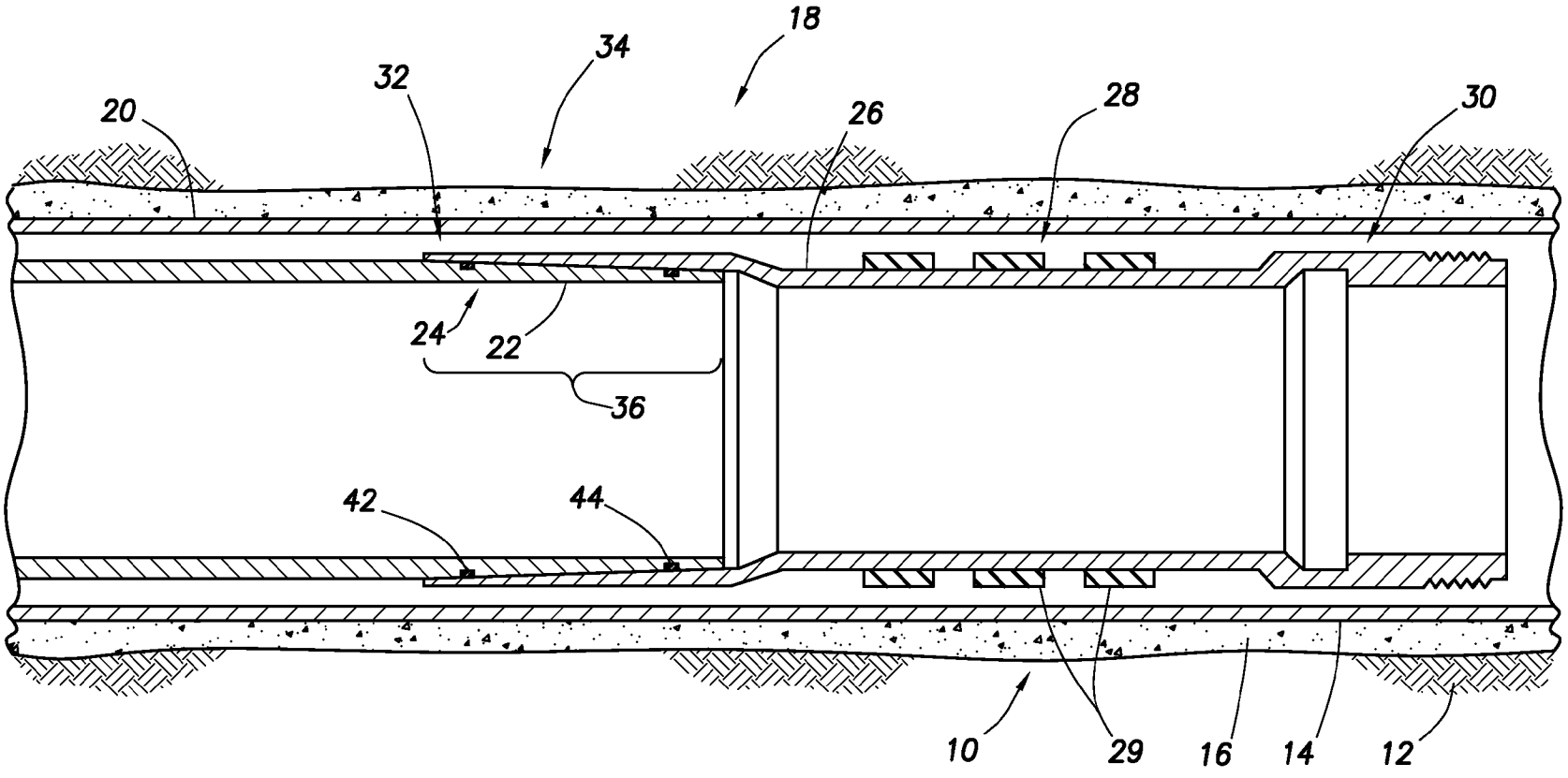
FIG. 1, a schematic illustration is shown of a preferred embodiment of a tie back assembly according to an aspect of the invention.

Embodiments of the present invention generally relate to methods and apparatus for completing a well. The invention relates more particularly to a tie back assembly having a tie back seal and tie back seal receptacle and a method of use thereof Referring more particularly to the drawings, wherein like reference characters are used throughout the various figures to refer to like or corresponding parts, there is shown in the figures, an exemplary embodiment of a tieback seal system of the present invention.

Turning first to FIG. 1, a schematic illustration is shown of a preferred embodiment of a tie back assembly according to an aspect of the invention. A wellbore 10 extends through a formation 12. At least a portion of the wellbore has a casing 14 positioned therein and held in place by cement 16. An exemplary tie back assembly 18 includes a tie back member 20 having a tie back seal mandrel 22 at its lower end 24, and a tie back receptacle member 26. The exemplary tie back receptacle member 26 includes a hanger body 28, a setting sleeve 30, and a tie back receptacle 32 formed at its upper end 34. The tie back assembly is used to form a pressure tight seal assembly 36 between the tie back member 20 and tie back receptacle member 26.

It is understood that the tubular members can be other tubing or tubulars as are used in the industry, such as part of a work string, production string, liner, hanger, etc. Further, the tie back assembly can be positioned in the well by a tubing string, wireline or coiled tubing.

In this embodiment, the telescoped or overlapping portion of tie back member 20 comprises a tie back seal mandrel 22. The telescoped or overlapping portion of tie back receptacle member 26 comprises a tie back seal receptacle 32. The outer surface 38 of the seal mandrel 22 is positioned interior and adjacent to, and longitudinally overlapping with, the inner surface 40 of the tie back seal receptacle 32. The seal assembly 36 includes, in a preferred embodiment, a collapse seal 42 and a burst seal 44 positioned between the seal mandrel outer surface 38 and the tie back receptacle inner surface 40. The seals can be carried on either member, although preferably on the seal mandrel, and are designed to seal the annular space between the mandrel and tie back receptacle. Such seals are commercially available and are known in the art. The seals are typically elastomer, plastic, nylon, a relatively soft metal or other deformable material capable of withstanding a corrosive, high temperature or otherwise damaging downhole environment.

Well known technology permits wellbore tubulars to be expanded in situ. In addition to simply enlarging a tubular, the technology permits the physical attachment of a smaller tubular to a larger tubular by increasing the outer diameter of a smaller tubular with radial force from within. The expansion can be accomplished by a mandrel or a cone-shaped member urged through the tubular to be expanded or by an expander tool run in on a tubular string. For an example of an expander tool see: U.S. Pat. No. 7,779,910, issued Aug. 24, 2010, to Watson entitled Expansion Cone For Expandable Liner Hanger, which is incorporated herein by reference for all purposes. The term "expander tool" is used herein to refer to any member that used to expand a tubular, such as the roller expander tool, a cone member, hydraulic pressure or any other type of expansion member used in the oil and gas industry. The hanger assembly 28 and setting sleeve assembly 30 are not described in detail herein as they are well known in the art. The hanger assembly 28 includes a plurality of seals 29 for sealing between the casing 14 and the tubing member 26. The hanger shown is an expandable hanger and the annular seals 29 are moved into sealing contact with the casing during expansion.

Figure 2:
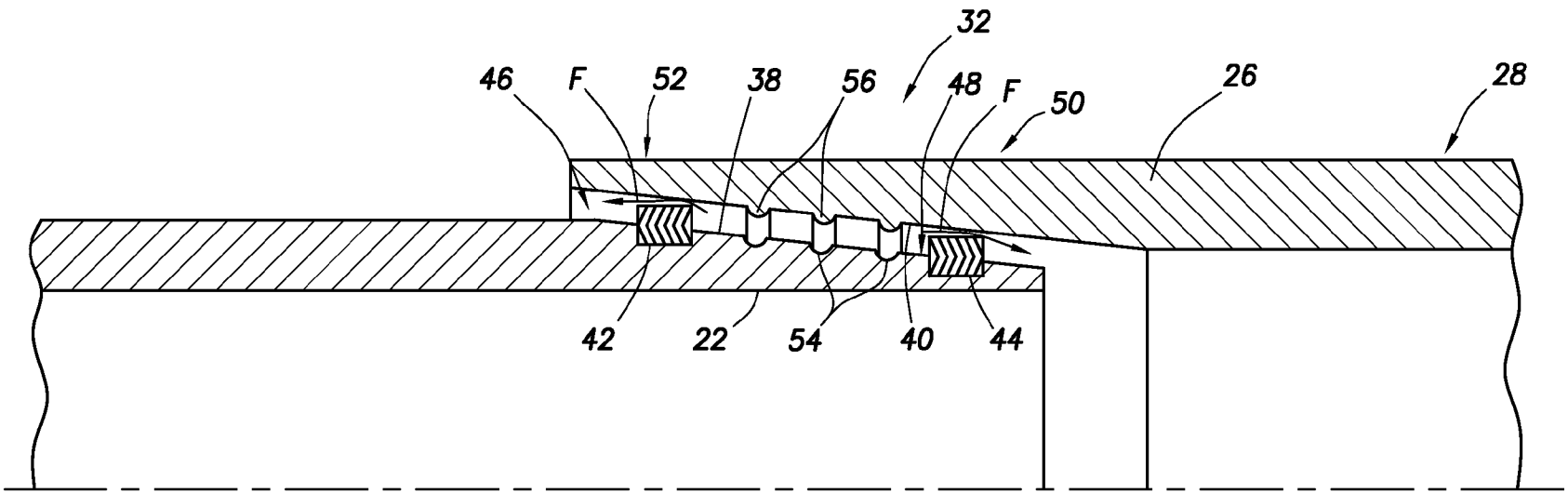
FIG. 2 is a schematic detail of FIG. 1 showing an exemplary tie back receptacle and seal mandrel according to an aspect of the invention.

FIG. 2 is a schematic detail of FIG. 1 showing an exemplary tie back receptacle and seal mandrel according to an aspect of the invention. The inner diameters of the tie back receptacle member 26 and seal member 20 are substantially identical, forming a mono-diameter assembly, in the preferred embodiment, as indicated by the dotted line. The figure is designed to provide a clearer understanding of the apparatus and method although the assembly elements are shown spaced apart in the figure, items and spaces are not to scale, etc. The seal mandrel and tie back receptacle are shown as not contacting one another, for example, except at the burst and collapse seals. In use, it is understood that the tapered surfaces of the seal mandrel and tie back receptacle would, in fact, touch. The hanger body 28 is here shown expanded.

The seal mandrel outer surface 38 is tapered from a relatively larger diameter at its upper end 46 to a relatively smaller diameter at its lower end 48. Consequently, the seal mandrel 22 has a relatively thicker cross-section of material at its upper end 46 and a relatively thinner cross-section of material at its lower end 48. Similarly, the tie back receptacle inner surface 40 is tapered from a relatively larger diameter at its lower end 50 to a relatively smaller diameter at its upper end 52. Consequently, the tie back receptacle 32 has a relatively thinner cross-section of material at its upper end 52 and a relatively thicker cross-section of material at its lower end 50. The tapered surfaces 38 and 40 cooperate, when the seal mandrel is inserted into the tie back receptacle, and enable sealing between the mandrel and receptacle. Thus, the invention provides an increase in the thickness of the TBR at the lower end and thins the TBR at the upper end in comparison to prior art assemblies. It also increases the thickness of the seal mandrel at the upper end and decreases the thickness at the lower end in comparison to prior art assemblies. In a preferred embodiment, the tapered surfaces are conical, however, the tapered surfaces can take other designs, such as a plurality of generally trapezoidal flat surfaces, etc. The collapse seal is positioned along a portion of the seal mandrel where the mandrel wall is thick enough to support the collapse seal at a targeted collapse pressure, such as at upper end 46. In a preferred embodiment, the same pressure would not be successfully held if the collapse seal was placed along the seal mandrel at a location having a thinner wall, such as at lower end 48. Similarly, the burst seal is positioned along a portion of the tie back receptacle where the wall is thick enough to support the burst seal at a targeted burst pressure, such as at lower end 50. In a preferred embodiment, the same burst pressure would not be successfully held if the burst seal was placed along the tie back receptacle at a location having a thinner wall, such as at upper end 52.

Preferably the collapse seal 42 and burst seal 44 are spaced apart, as shown, although other arrangements are possible. The collapse seal 42 is seen positioned at a location along the upper end 46 where the seal mandrel 22 is relatively thicker. This arrangement results in higher burst and collapse ratings due to the relatively thicker material between the burst seal and hanger body and between the collapse seal and tie back body. The member material between the burst and collapse seals is supported because of the two nested cylinders.

In a preferred embodiment, the seal is self-locking in response to hydrostatic pressure. The self-locking seal works something like a suction cup. As the seal is moved into a sealed position, and/or when in the sealed position, liquid trapped between the burst and collapse seals and between the tapered surfaces will be forced out over one or both seals, such as along flow path F. The seals will typically be unable to hold significant fluid pressure between the seals due to the thin section. Further, the seals can be designed to purposely allow fluid to escape from the area between the seals. When the tie back seal mandrel is withdrawn from the tie back receptacle, a lower pressure area is formed between the seals since the volume between the seals is increasing. The lower pressure will cause the seal mandrel to expand and the tie back receptacle to shrink. This relative expansion and shrinkage will cause a substantial increase in friction between the tie back receptacle and the seal mandrel.

FIG. 2 also shows an optional latching assembly having circumferential grooves 54 formed in the outer surface 38 of the seal mandrel 22 and corresponding and cooperating circumferential ridges 56 formed on the inner surface 40 of the tie back receptacle 32. The grooves increase the pullout drag force when the seal mandrel is withdrawn from the tie back receptacle. The grooves and ridges are designed such that they will snap together elastically during insertion of the seal mandrel into the tie back receptacle. The locking grooves and ridges are preferably positioned along the seal mandrel and tie back receptacle in the area between the burst and collapse seals.

Figure 3:
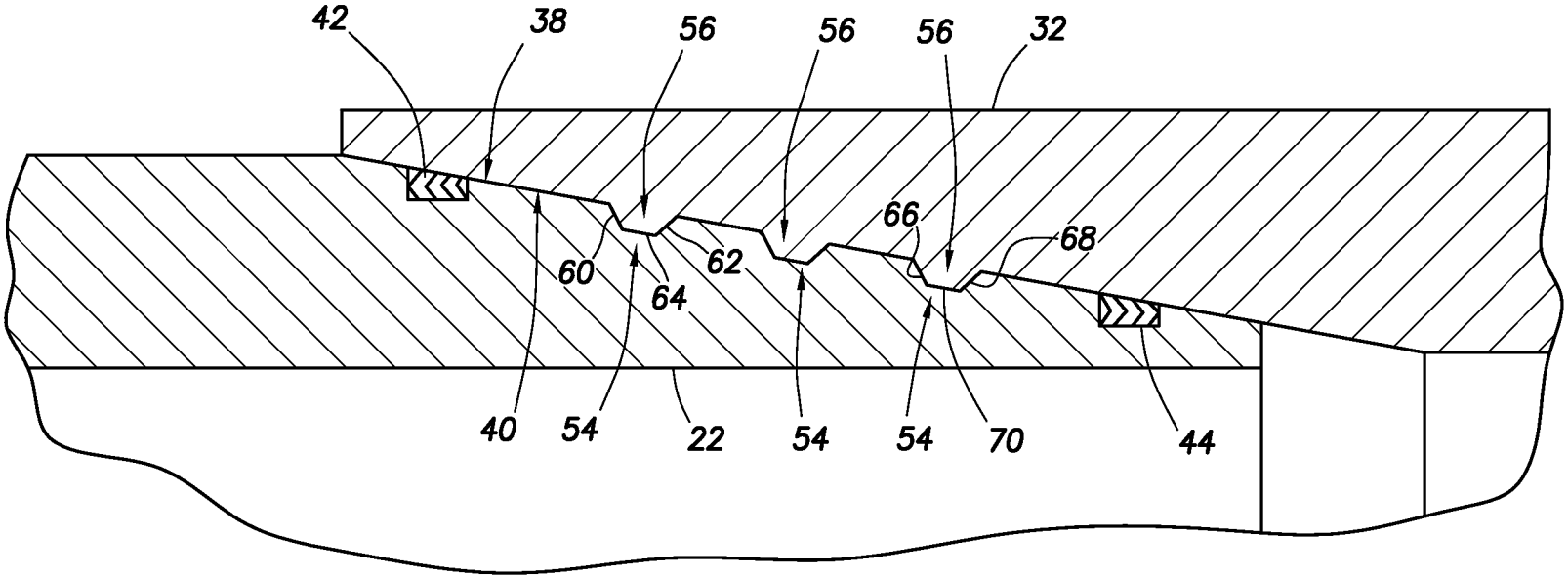
FIG. 3 is a detail schematic view of an exemplary ridge and groove mating assembly according to an aspect of the invention

FIG. 3 is a detail schematic view of an exemplary ridge and groove mating or latching assembly according to an aspect of the invention. The tie back seal mandrel 22 has a plurality of circumferential grooves 54 formed in its tapered surface 38. The tie back receptacle 32 has a corresponding and cooperating plurality of circumferential ridges 56 extending from its tapered surface 40. As can be seen, the grooves 54 are preferably acme-style grooves, that is, defined by flat angled walls 60 and 62 and a flat bottom surface 64. The ridges 56 similarly have flat angular walls 66 and 68 and a flat top surface 70. When the seal mandrel is inserted into the tie back receptacle, the ridges and grooves lock into cooperating positions, as seen in FIG. 3. The grooves increase the pullout drag force when the seal mandrel is withdrawn from the tie back receptacle. The grooves and ridges are designed such that they will snap together elastically during insertion of the seal mandrel into the tie back receptacle. The locking grooves and ridges are preferably positioned along the seal mandrel and tie back receptacle in the area between the burst and collapse seals. The grooves and ridges can be substituted with alternative structures as are known in the art.

In use, a preferred method includes at least some of the following steps for assembling together a tie back receptacle member and a tie back seal member in a wellbore extending through a subterranean formation: positioning the tie back receptacle member in the wellbore at a downhole location where the wellbore comprises a casing; hanging the tie back receptacle member in the wellbore and supported by the casing; running the tie back seal member into the wellbore, the tie back seal member having a seal mandrel at its lower end, the seal mandrel having a tapered outer surface; positioning the seal mandrel into the tie back receptacle member, the tie back receptacle member defining a tie back receptacle having a tapered inner surface; and sealing the tapered surfaces against one another by moving at least one seal carried on one of the tapered surfaces into sealing engagement with the other tapered surface. Additional potential steps and features include: wherein the tie back receptacle member further comprises a hanger body, and further comprising the step of expanding the hanger body into sealing engagement with the casing; wherein at least one seal is carried on the tapered surface of the seal mandrel; wherein the at least one seal comprises a burst seal and a collapse seal, the burst and collapse seals spaced apart from one another; moving the burst seal into sealing engagement between the tapered surfaces and moving the collapse seal into sealing engagement between the tapered surfaces; wherein an annular space is defined between the burst and collapse seals and the tapered surfaces, and further comprising the step of flowing wellbore fluid out of the annular space; wherein the step of flowing wellbore fluid out of the annular space further comprises flowing wellbore fluid over at least one of the collapse and burst seals; creating a lower pressure in the annular space than the hydrostatic pressure in the wellbore; wherein the step of flowing wellbore fluid out of the annular space further comprises, flowing wellbore fluid out of the annular space after the seal mandrel is positioned in sealing engagement with the tie back receptacle; wherein the lower pressure in the annular space is created during a further step of withdrawing the seal mandrel from the tie back receptacle; expanding the seal mandrel in response to creating the lower pressure in the annular space; contracting the tie back receptacle in response to creating the lower pressure in the annular space; fastening the tie back receptacle member and the seal member together; interlocking coordinating grooves and ridges on the tapered surfaces of the seal mandrel and tie back receptacle; and wherein the grooves and ridges are positioned between the burst and collapse seals.

While compositions and methods are described in terms of "comprising," "containing," or "including" various components or steps, the compositions and methods also can "consist essentially of" or "consist of" the various components and steps. As used herein, the words "comprise," "have," "include," and all grammatical variations thereof are each intended to have an open, non-limiting meaning that does not exclude additional elements or steps.

Therefore, the present inventions are well adapted to carry out the objects and attain the ends and advantages mentioned as well as those which are inherent therein. While the invention has been depicted, described, and is defined by reference to exemplary embodiments of the inventions, such a reference does not imply a limitation on the inventions, and no such limitation is to be inferred. The inventions are capable of considerable modification, alteration, and equivalents in form and function, as will occur to those ordinarily skilled in the pertinent arts and having the benefit of this disclosure. The depicted and described embodiments of the inventions are exemplary only, and are not exhaustive of the scope of the inventions. Consequently, the inventions are intended to be limited only by the spirit and scope of the appended claims, giving full cognizance to equivalents in all respects.

Also, the terms in the claims have their plain, ordinary meaning unless otherwise explicitly and clearly defined by the patentee. Moreover, the indefinite articles "a" or "an", as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A method of assembling together a tie back receptacle member and a tie back seal member in a wellbore extending through a subterranean formation, the method comprising the steps of:

positioning the tie back receptacle member in the wellbore at a downhole location where the wellbore comprises a casing;

hanging the tie back receptacle member in the wellbore and supported by the casing;

running the tie back seal member into the wellbore, the tie back seal member having a seal mandrel at its lower end, the seal mandrel having a tubular wall defining a tapered outer surface extending from a relatively thick-walled upper end to a relatively thin-walled lower end;

positioning the seal mandrel into the tie back receptacle member, the tie back receptacle member having a tubular wall defining a tapered inner surface extending from a relatively thick-walled lower end to a relatively thin-walled upper end;

sealing the tapered surfaces of the seal mandrel and the tie back receptacle member against one another by moving at least a burst seal and a collapse seal carried on one of the tapered surfaces into sealing engagement with the other tapered surface, wherein the burst and collapse seals are spaced apart from one another;

supporting the collapse seal against a targeted collapse pressure using the thick-walled upper end of the seal mandrel, the relatively thin-walled lower end of the seal mandrel having a collapse strength below the targeted collapse pressure; and supporting the burst seal against a targeted burst pressure using the relatively thick-walled lower end of the tie back receptacle member, the relatively thin-walled upper end of the tie back receptacle member having a collapse strength below the targeted burst pressure.

2. The method according to claim 1, wherein the tie back receptacle member further comprises a hanger body, and further comprising the step of expanding the hanger body into sealing engagement with the casing.

3. The method according to claim 1, further comprising the step of moving the burst seal into sealing engagement between the tapered surfaces and moving the collapse seal into sealing engagement between the tapered surfaces.

4. The method according to claim 3, wherein an annular space is defined between the burst and collapse seals and the tapered surfaces, and further comprising the step of flowing wellbore fluid out of the annular space in response to moving the burst and collapse seals into sealing engagement with the tapered surfaces.

5. The method according to claim 4, wherein the step of flowing wellbore fluid out of the annular space further comprises flowing wellbore fluid over at least one of the collapse and burst seals.

6. The method according to claim 4, further comprising the step of creating a lower pressure in the annular space than the hydrostatic pressure in the wellbore.

7. The method according to claim 6, wherein the lower pressure in the annular space is created by withdrawing the seal mandrel at least partially from the tie back receptacle member.

8. The method according to claim 7, further comprising the step of expanding the seal mandrel in response to creating the lower pressure in the annular space.

9. The method according to claim 8, further comprising the step of contracting the tie back receptacle member in response to creating the lower pressure in the annular space.

10. The method according to claim 4, wherein the step of flowing wellbore fluid out of the annular space further comprises, flowing wellbore fluid out of the annular space after the seal mandrel is positioned in sealing engagement with the tie back receptacle member.

11. The method according to claim 1, further comprising the step of fastening the tie back receptacle member and the seal member together.

12. The method according to claim 11, further comprising the step of interlocking coordinating grooves and ridges on the tapered surfaces of the seal mandrel and tie back receptacle member.

13. The method according to claim 12, wherein the grooves and ridges are positioned between the burst and collapse seals.

14. A tie back assembly for use in a subterranean wellbore, the assembly comprising:

a seal mandrel having a tubular wall defining a tapered outer surface extending from a relatively thick-walled upper end to a relatively thin-walled lower end;

a tie back receptacle of a size to receive the seal mandrel therein, the tie back receptacle having a tubular wall defining a tapered inner surface extending from a relatively thick-walled lower end to a relatively thin-walled upper end, the tapered inner surface corresponding to the tapered outer surface of the seal mandrel; and an annular seal assembly positioned between the tapered outer surface of the seal mandrel and the tapered inner surface of the tie back receptacle, the annular seal assembly comprising a collapse seal and a burst seal longitudinally spaced apart from one another;

wherein the collapse seal is supported against a targeted collapse pressure by the relatively thick-walled upper end of the seal mandrel;

wherein the relatively thin-walled lower end of the seal mandrel is not able to support the collapse seal against the targeted collapse pressure;

wherein the burst seal is supported against a targeted burst pressure by the relatively thick-walled lower end of the tie back receptacle; and wherein the relativel thin-walled upper end of the tie back receptacle is not able to support the burst seal against the targeted burst pressure.

15. The assembly according to claim 14, wherein an annular space is defined between the collapse seal and the burst seal, and between the tapered inner surface of the tie back receptacle and the tapered outer surface of the seal mandrel;

wherein the seals are designed to hold against less pressure from fluid trapped in the annular space than pressure from fluid exterior to the annular space.

16. The assembly according to claim 15, wherein a relatively lower pressure area is produced in the annular space between the collapse seal and the burst seal when the seal mandrel is removed from the tie back receptacle.

17. The assembly according to claim 14, further comprising a plurality of surface structures formed on the tapered outer surface of the seal mandrel and a corresponding plurality of surface structures formed on the tapered inner surface of the tie back receptacle, the surface structures cooperating to produce an increase in drag force when the seal mandrel is removed from the tie back receptacle.

* * * * *